US006772987B2

(12) United States Patent
Jones, II

(10) Patent No.: US 6,772,987 B2
(45) Date of Patent: Aug. 10, 2004

(54) PORTABLE EASEL ASSEMBLY

(76) Inventor: Donald Richard Jones, II, 938 N. Brighton St., Burbank, CA (US) 91506

( * ) Notice: Subject to any disclaimer, the term of this patent is extended or adjusted under 35 U.S.C. 154(b) by 0 days.

(21) Appl. No.: 10/242,997

(22) Filed: Sep. 13, 2002

(65) Prior Publication Data

US 2003/0010884 A1 Jan. 16, 2003

Related U.S. Application Data

(63) Continuation-in-part of application No. 09/870,208, filed on May 30, 2001, now abandoned.
(60) Provisional application No. 60/208,400, filed on May 30, 2000, and provisional application No. 60/232,959, filed on Sep. 14, 2000.

(51) Int. Cl.[7] ..... A47B 97/04
(52) U.S. Cl. ..... 248/464; 248/441.1; 248/460; 248/463
(58) Field of Search ..... 248/441.1, 431, 248/168, 464, 461, 462, 439, 177.1, 213.1; 16/223, 365, 368

(56) References Cited

U.S. PATENT DOCUMENTS 4,480,810 A * 11/1984 Hall ..... 248/238
5,168,426 A * 12/1992 Hoving et al. ..... 361/681
5,655,651 A * 8/1997 Maier ..... 206/1.7
5,774,333 A * 6/1998 Janik et al. ..... 361/687

* cited by examiner

*Primary Examiner*—Leslie A. Braun
*Assistant Examiner*—Steven M. Marsh
(74) *Attorney, Agent, or Firm*—Kelly Lowry & Kelley, LLP

(57) ABSTRACT

A portable easel assembly includes a paint/sketch box having a base and lid connected by a hinge assembly. The base defines a cavity for storing art supplies, and the lid is configured to support a painting surface. The base and lid are inter-connected with a slide bar assembly. Use of the slide bar assembly and hinge assembly enable the lid to be secured in a number of positions. Preferably, first, second and third legs of adjustable length are pivotally attached to the base and moveable between folded positions and extended, supportive positions.

24 Claims, 7 Drawing Sheets

PORTABLE EASEL ASSEMBLY

RELATED APPLICATION

This application is a continuation-in-part of U.S. patent application Ser. No. 09/870,208, filed May 30, 2001, Now ABANDONED, which claims priority from provisional application Serial No. 60/208,400 filed May 30, 2000, and provisional application Serial No. 60/232,959 filed Sep. 14, 2000.

BACKGROUND OF THE INVENTION

The present invention generally relates to artist easels. More particularly, the present invention relates to a portable easel assembly including a paint/sketch box constructed to allow a painter to adjust and set a canvas bearing portion of the box in various position and angles.

Paint box easels have been in existence for hundreds of years. Their purpose is to allow an artist to work outside of the convenience of a studio. They are constructed much like a briefcase or a laptop computer, having two halves hinged at the back that can be laid flat and opened up. The first bottom half or base holds the artist's materials such as paint tubes, brushes, medium and thinner.

The second or vertically extending half or lid is the easel area of the paint box. The canvas, or other suitable surface to create images on, is either held by a clamping system on the outside surface of the lid top, or in the inside of the lid by slots extending along the length of both sides of the box.

When the canvas is held by the outside of the lid, the artist must work from behind the box. The lid can be set at a suitable angle of less than 90 degrees by the use of adjustable side supports. The artist, however, can not see or reach his materials unless he goes around to the front of the box. The standard solution to this problem is to install a drawer that opens out of the back of the box and toward the artist. The top of this drawer normally has a lip that a palette board for mixing paint can rest on covering the artist's materials and held in place by the box's lid when in the closed position.

When the canvas board is held by slots in the inside of the lid, the artist works from the front of the box and the lid now must open more than 90 degrees to be at a suitable angle. Some boxes use lid supports that open to one preset angle and others use a more complex system that allows for variable angle settings. This type of box also usually stores the palette board over the art materials.

Convenience, portability and efficiency are the attractions of a paint box easel. The artist may rest the box on his lap to make studies and sketches in public places. He may sit low on a rock or stool and open the box on the ground for landscape painting. Many a novice or student has been enchanted by the possibilities of a paint box easel only to discover its use to be quite limited.

The major difficulty is that the box is hinged at the back in the traditional manner. If the box is the type that opens more than 90 degrees, the canvas being held in by the slots inside the lid, then a balance problem exists causing the entire box to tip back when any slightly vigorous brushwork is attempted. This can mar the work and cause open bottles of medium and thinner to spill. The artist is not enthused by having to steady the box with one hand while painting with the other.

If the box is the type that holds the canvas on the outside of the lid, the artist working from the back of the box, then he is faced with inaccessible materials or the added expense and weight of a pull out drawer.

With either type of box it should be remembered that the palette board must be held away from the box bottom or drawer in order to access materials while the artist is probably holding several loaded brushes and a paint rag in his non-painting hand.

A further problem is caused by the traditional use of a support that holds the lid of the easel box at a fixed angle (unless one hand tips the box back and holds it in position). If the artist wants the painting surface to be flat so a wash can be laid down and controlled he or she must empty the contents of the box and lay the easel side flat, or remove the canvas from the paint box and hold it level while trying to apply the wash. A landscape painter cannot change his position in response to a need to adjust to the sun's position because a glare is coming off of his wet canvas. That would alter his point of view. Instead, he or she must change the angle or height of his or her work. Accessibility to painting materials is limited or completely restricted in prior paint boxes when the palette is resting on top of the open box bottom.

Paint box easels are often converted from tabletop to stand up usage by either adding three extendable legs or a fitted mounting on the box base that accommodates a camera tripod. The camera tripod version is normally used on boxes that open wider than 90 degrees where the artist is working from the front of the box. They are notoriously wobbly unless an expensive high quality professional tripod is used. This method is generally used on boxes that are quite small since a larger box will tend to twist sideways under pressure from the wind or normal painting activity.

The extendable leg version is the type known as a French easel. A folding leg is attached to each side of the box and a third leg is folded into a cavity in the bottom middle of the box so that the easel will still sit flat when being used as a tabletop easel. The lid carries the canvas on its outside surface, the artist working from the back of the box and needing a drawer to access his materials as described above. The folded up middle leg takes up valuable space in the materials storage area and greatly reduces the depth of the drawer that can be used as well as increasing the complexity and cost of manufacture.

The French easel with its folding legs does provide a stable surface, but unfolding and extending each leg while supporting the easel itself can resemble a clumsy wrestling match. The French easel also tends to be larger and heavier than the sketch/paint box easel. This is because the folding legs require a certain amount of space in order to store themselves and still open up with enough length to accommodate an artist creating her or his work in the standing position. Size and weight are key considerations for both the landscape painter and the art school student who must transport their art supplies to a variety of locations in order to create their art.

Accordingly, there is a need for an improved paint box which holds artist's materials and canvas boards similar to a traditional paint box, but which allows the artist to adjust the position and angle of the lid of the paint box. What is also needed is a paint box that allows the artist to conveniently access his or her supplies while mixing colors and painting. What is further needed is a paint box that includes an improved tripod assembly. The present invention fulfills these needs and provides other related advantages.

SUMMARY OF THE INVENTION

The present invention resides in a portable easel assembly comprising a paint/sketch box design such that the artist can adjust the position and angle of a lid of the box while conveniently accessing his or her supplies within the box. The paint/sketch box generally comprises a base defining a cavity for storing art supplies, and a lid connected to the base by a hinge assembly and configured to support a surface to be painted thereon. A slide bar assembly interconnects the base and lid. The slide bar assembly includes a slide bar having a slot substantially extending the length thereof, and posts extending from the base and lid and into the slide bar slot. The posts are selectively positioned within the slot with hand-actuatable knobs. The hinge assembly comprises a first brace attached to a rear surface of the base and extending upwardly to a point above the top edge of the base. A second brace is attached to a top surface of the lid. A third brace is pivotally interconnected between the first and second braces. This arrangement allows for the intended positioning of the lid with respect to the base.

In a particularly preferred embodiment, the lid includes a front wall moveable between open and closed positions. Opposing grooves are formed on inner surfaces of the walls of the lid for reception of a canvas board or the like. Wings are pivotally attached to the base and have a plurality of apertures therethrough for supporting paint brushes. A paint mixing palate is slidably receivable within opposing grooves of sidewalls of the base.

In a particularly preferred embodiment, first, second and third legs are pivotally attached to the base and moveable between extended and folded positions. Each leg is pivotally attached to a mount fixed to the base. Each mount has an opened-faced channel configured to receive an end of a leg. The channel includes a first open end directed generally transverse to a plane of the base, and a second open end directed generally parallel to plane of the base. The legs are moveable from a folded and supportive position in which the leg extends through the second end of the channel, to an unfolded and supportive position wherein the leg extends to the first end of the channel.

Each leg is adjustable in length. Each leg comprises first and second extension slidably connected to one another. The second extension has at least a portion thereof slidably received in an opened-face channel of the first extension. The second extension is secured in position with a clamp extending from the second extension through a slot of the first extension. A foot bar is slidably disposed within an opened face channel of the second extension, with a clamp extending from the foot bar and through the slot of the second extension to lock the foot bar in place. Preferably, each clamp comprises a threaded post extended through the respective slot to a hand-actuatable knob threadably received thereon.

The easel assembly of the present invention overcomes the disadvantages of prior easel assemblies. It is compact for easy storage, yet can easily be unfolded for use in a variety of positions. The lid of the assembly can be directed at several orientations, and is configured to securely support a surface to be painted, such as a canvas board. The artist's paint supplies and mixing palates are easily assessable during use, and easily stored when transporting the assembly. The legs of the assembly can be adjusted in height so that an artist may sit, or artist of different height may utilize the assembly in a standing position.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompany drawings illustrate the invention. In such drawings.

DETAILED DESCRIPTION OF THE PREFERRED EMBODIMENTS

Figure 1:
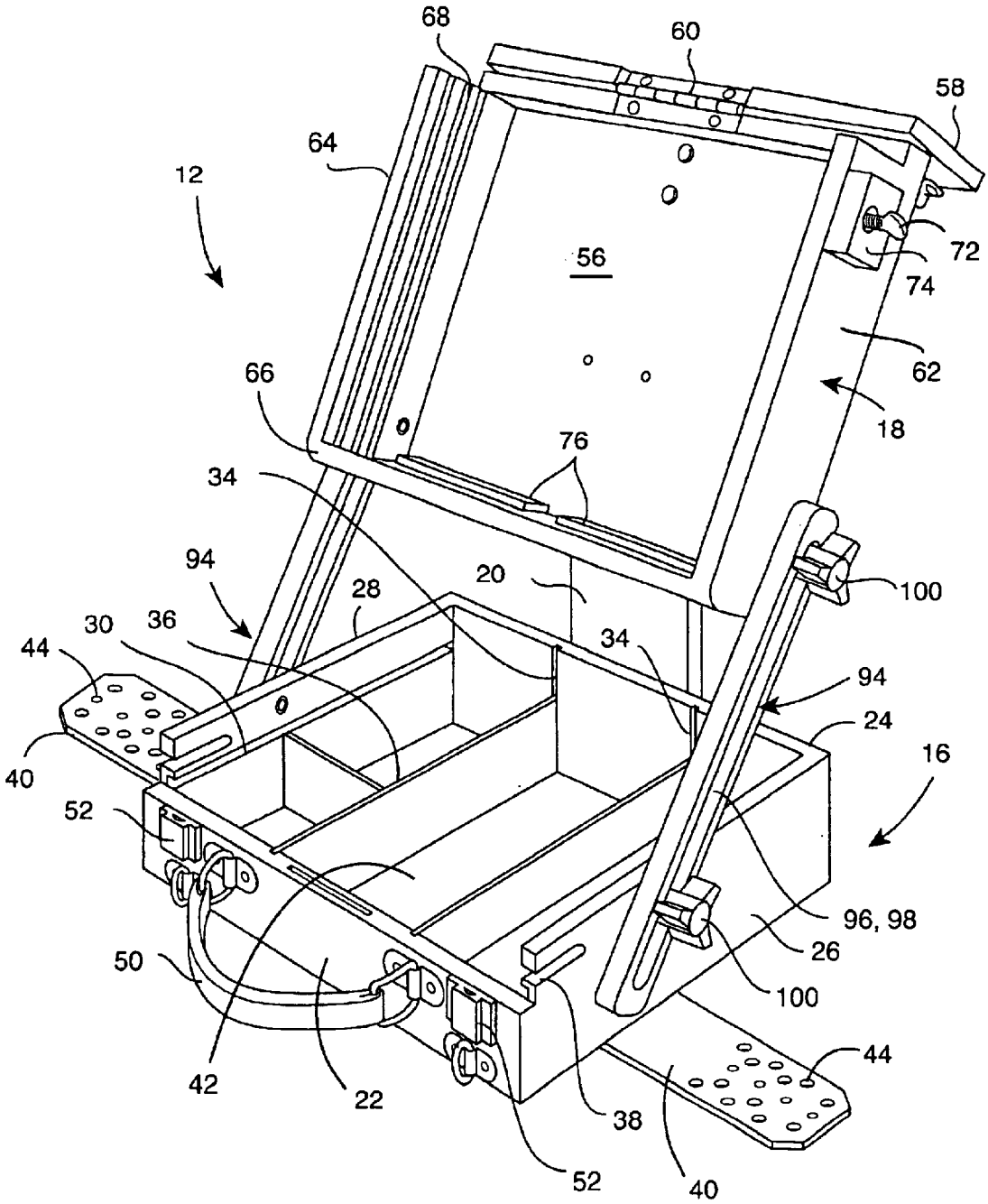
FIG. 1 is a perspective view of a paint/sketch box embodying the present invention in an opened state.

As shown in the drawings for purposes of illustration, the present invention is concerned with a portable easel assembly, generally referred to in the figures by the reference number 10. The assembly 10 is generally comprised of a paint/sketch box 12 which may include a supporting leg structure.

Figure 2:
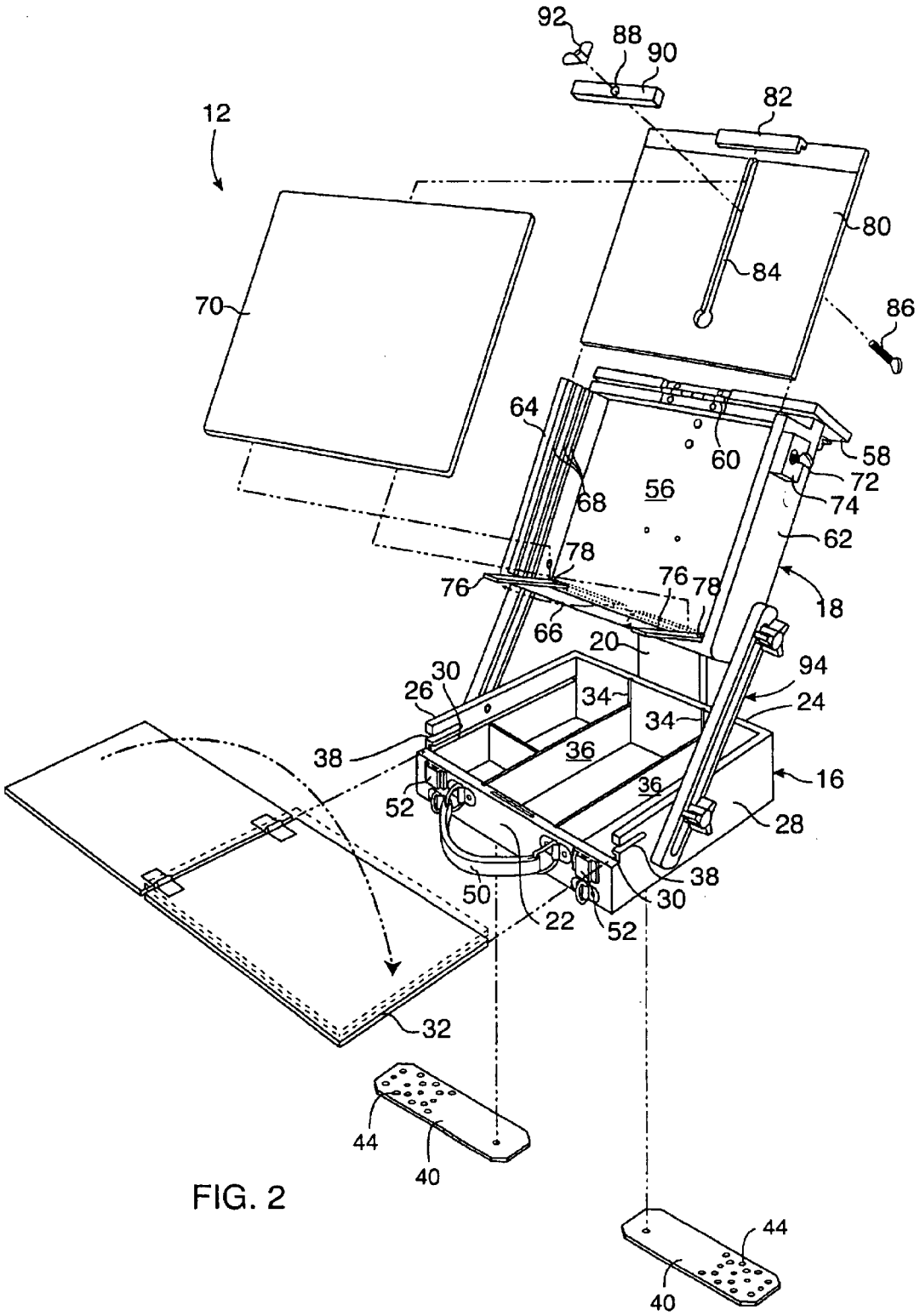
FIG. 2 is a partially exploded perspective view of the paint/sketch box of FIG. 1.

With reference now to FIGS. 1 and 2, the paint/sketch box 12 is comprised of a base 16 connected to a lid 18 by a hinge assembly 20. The base 16 includes a front wall 22, a back wall 24, and opposing side walls 26 and 28 which form an open-faced square or rectangular containment area therebetween. Horizontal slots 30 are formed in each of the side walls 26 and 28 so as to be parallel and generally aligned with one another. A pallet 32, such as a wood or glass paint mixing pallet, is insertable into the slots 30 so that the artist can conveniently mix paints, use the pallet 32 as a shelf, and cover the contents of the base 16. The pallet 32 preferably includes two segments pivotally connected to one another so as to be foldable. This enables the pallet 32 to be inserted into the base 16, when folded, yet unfolded to present a large surface area for mixing paints and the like and which can be supported in open-faced apertures formed in front edges of the side walls 26 and 28 above the front wall 22. These apertures 38 extend into the side walls 26 and 28 a predetermined distance to allow platforms, such as the illustrated pallet 32, to be inserted therein sufficiently to be adequately supported.

Vertical slots 34 are formed opposite one another in the front and back walls 22 and 24 of the base 16 for insertion of slats 36 which serve to compartmentalize the base 16 in order to separate tubes of paint, rags, brushes, etc. placed within the base 16.

Figure 8:
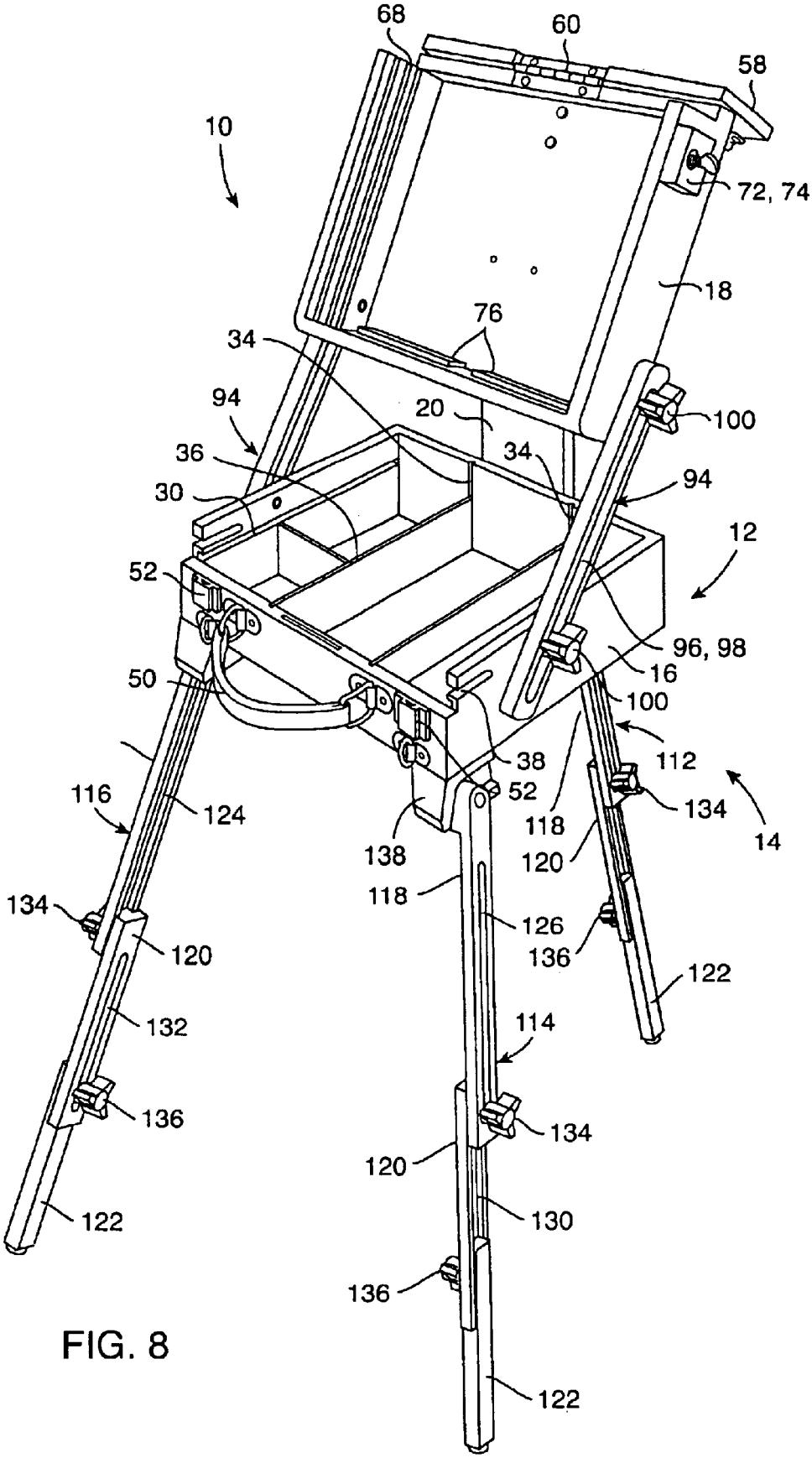
FIG. 8 is a perspective view of the portable easel assembly, with the paint brush supporting wings pivoted under the paint/sketch box.
Figure 9:
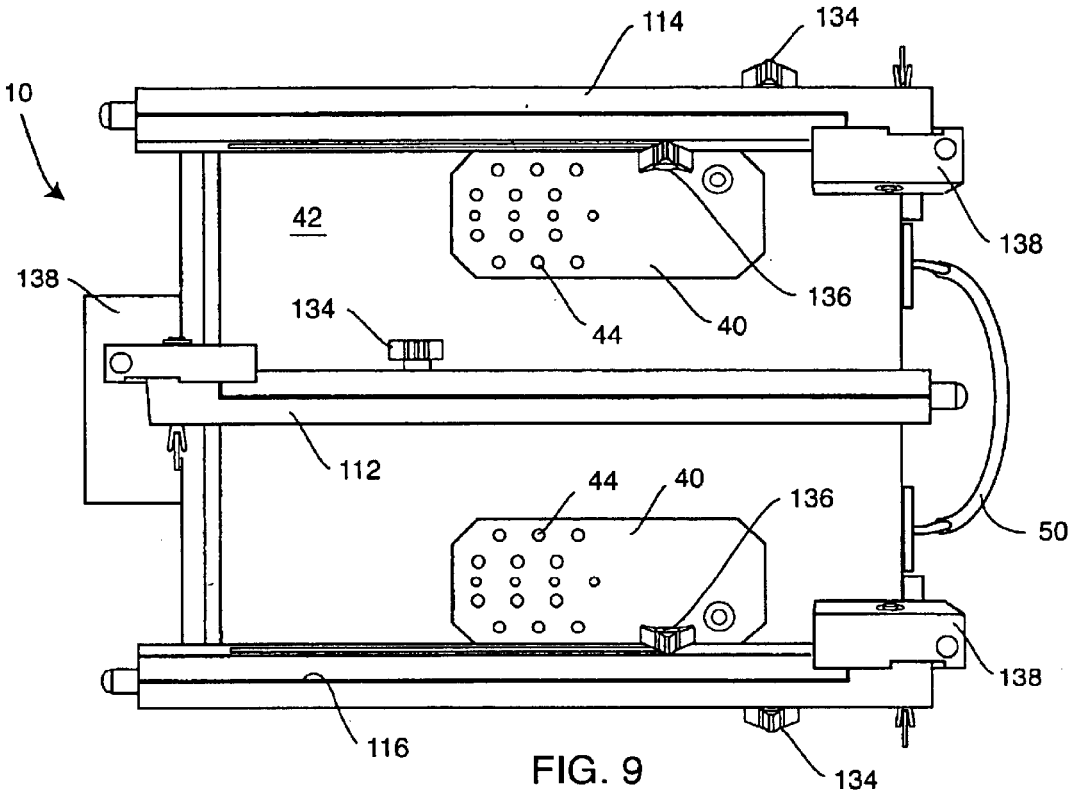
FIG. 9 is a bottom plan view of the portable easel assembly, illustrating the paint brush supporting wings and legs in a folded position under the paint/sketch box.

Wings 40 are pivotally attached to a bottom wall 42 of the base 16 so as to be pivotal between extended positions, illustrated in FIGS. 1 and 2, and folded positions, as illustrated in FIGS. 8 and 9. The wings 40 include a plurality of apertures 44 which may be of various diameters and are sized such so as to enable the insertion of paint brushes therein. This enables the artist to support a plurality of paint brushes (not shown) without fear of contaminating the paint thereon, or the need to continuously clean the brush end of the paint brushes due to fear of contamination.

Typically, the base 16 includes a handle 50 used to carry the paint/sketch box 12, lower portions of clamps 52 used to clamp shut the paint/sketch box 12.

The lid 18 includes a top wall 56, a front wall 58 which is formed in two segments connected by a hinge 60 to create a door. Opposing side walls 62 and 64 interconnect the front wall 58 with a back wall 66 of the lid 18. A series of opposing slits 68 are formed in the side walls 62 and 64 of the lid 18 for insertion of pre-cut canvas boards 70 or the like. A hand-actuatable bolt 72 extends through a block 74 attached to the side wall 62 which can be extended into a slot 68 so as to securely hold the canvas board 70 in place at the variable and desired height, while the artist is painting. The support legs 76 are attached to the interior side of the back wall 66 by a screw 78 or bolt inserted through one end of the support leg which serves as a pivot point so that the support leg 76 can be pivoted outwardly to support the canvas board 70 inserted within the slots 68 of the lid 18. Support legs 76 can support the bottom of a larger canvas when used this way.

A support board 80 is configured to be insertable into the slots 68, and includes a stop 82 attached to one end thereof, and an elongated slot 84 extending vertically at approximately the mid-line thereof and configured to receive a bolt 86 which is insertable through an aperture 88 of an adjustable stop 90 and secured in place by a wing nut 92. Thus, canvas boards of smaller size can be held in place by placing the canvas board onto the support board 80 and adjusting the position of the adjustable stop 90 along the elongated slot 84 until the canvas board is securely positioned between the stops 82 and 90. The hand-actuatable bolt 72 can be used with the support board 80 to change the height of the support board 80 and accommodate canvases larger than the box 12 itself. This allows the artist to work on a variety of sizes of canvas board 70.

Referring now to FIGS. 3–6, a slide assembly 94 is associated with both the base 16 and lid 18. The slide bar assembly 94 includes a slide bar 96 interconnected to the base 16 and lid 18 by threaded posts (not shown) which extend through a slot 98 substantially extending the length of the slide bar 96. Hand-actuatable knobs 100 are threaded onto the posts such that they can be tightened into contact with the slide bar 96 and prevent the movement thereof, and loosened to permit the slide bar 96 to slide freely.

Figure 3:
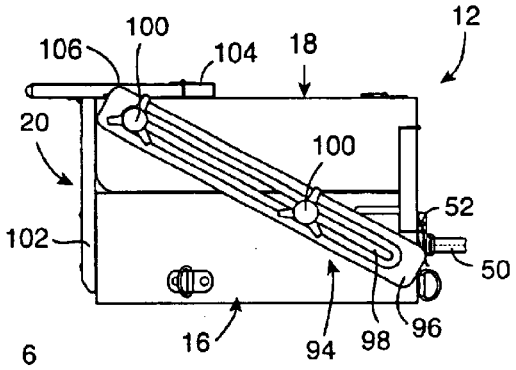
FIG. 3 is a side elevational view of the paint/sketch box in a closed state.
Figure 4:
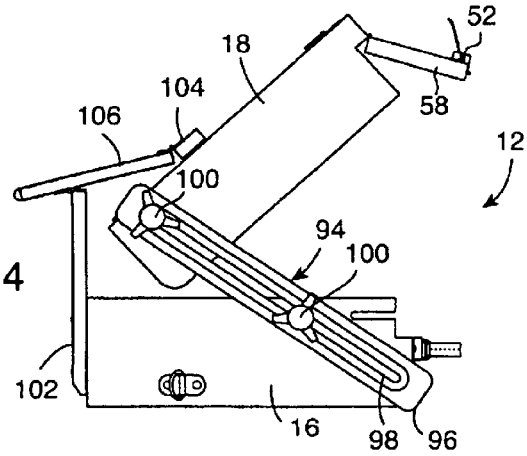
FIG. 4 is a side elevational view of paint/sketch box of FIG. 3 partially opened using a slide bar assembly and hinge assembly.
Figure 5:
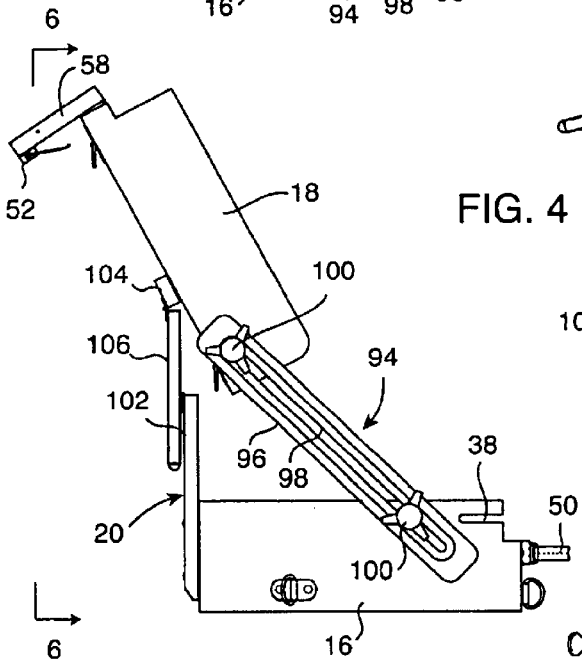
FIG. 5 is a side elevational view similar to FIG. 4, illustrating the paint/sketch box in a fully opened state.
Figure 6:
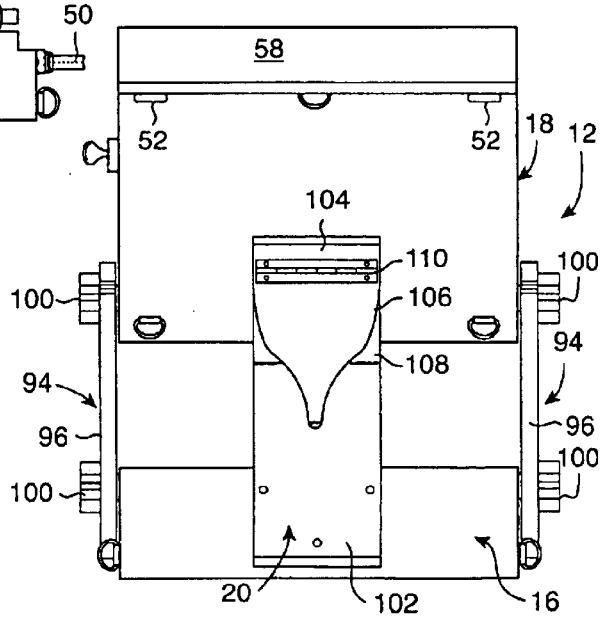
FIG. 6 is an end elevational view taken generally along line 6—6 of FIG. 5.

The previously mentioned hinge assembly 20 comprises a first brace 102 securely attached to the back wall 24 of the base 16 and extending upwardly therefrom to a point above back wall 24 of the base 16, and either above or co-planer with the top wall 56 of the lid 18. The lid 18 is not directly attached to the first brace 102. Instead, a second brace 104 is directly attached to the top wall 56 of the lid 18, and a third brace 106 is pivotally connected at one end thereof to the first brace 102, and pivotally attached to the second brace 104. This is typically done by attaching a hinge, such as a piano hinge or the like, 108 to the first brace 102 and third brace 106. Similarly, another hinge 110 is attached to the second brace 104 and end of the third brace 106. It is important to know that the third brace 106 is not connected directly to either the base 16 nor lid 18, but rather is allowed to freely move. The two separate hinge points allow the lid 18 to be moved to a nonadjacent plane. This allows the lid 18 to lift up and away from the base 16 in a serpentine motion that can be arrested at any position from straight up to perfectly flat, as illustrated in FIGS. 3–5, or at varying distance separation and angles and locked into position by tightening the knobs 100 against the slide bar 96 to prevent the lid 18 from being moved from position. Preferably, a bottom and rear edge of the lid 18 is rounded to facilitate opening of the lid 18 from the base 16.

In use, the clamps 52 on the front wall 22 of the base 16 and the front wall 58 of the lid 18 are disengaged. The knobs 100 are loosened from the posts extending from each side wall 26 and 28 of the base 16, as well as the posts extending from the side walls 62 and 64 of the lid 18 so as to allow the slide bar 96 to move. The lid 18 is then lifted from the base 16 and placed at the desired height and angle, as illustrated in FIGS. 4 and 5. The knobs 100 are then tightened on the threaded posts against the slide bars 96 to hold the lid 18 in place. The door 58 of the lid 18 can then be opened to permit access to the slots 68 in which the canvas board 70 or support board 80 reside. The door 58 also presents an advantage when the base 16 and lid are closed in that the artist can retrieve the canvas board 70, or other supplies, without the need to completely open the box 12. In the event that the lid 18 needs to be adjusted, the knobs 100 are simply loosened so that the slide bar 96 can be moved while the lid 18 is readjusted in height or angle.

Figure 7:
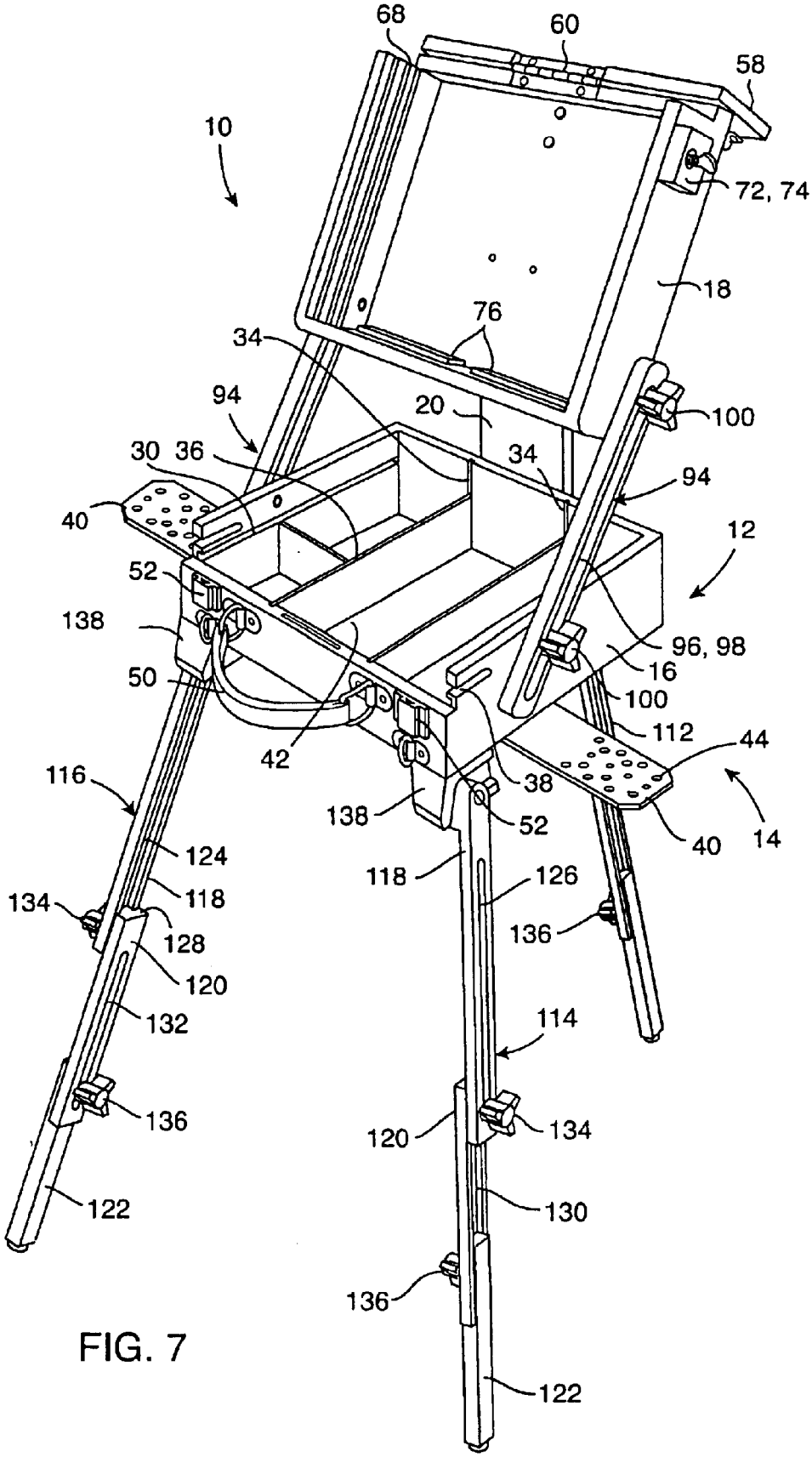
FIG. 7 is a perspective view of portable easel assembly including a paint/sketch box supported upon legs extending therefrom, and illustrating paint brush holder wings extending from the paint/sketch box.

With reference now to FIGS. 7 and 8, the paint/sketch box 12 in a particularly preferred embodiment includes first, second, and third legs 112–116 which are pivotally attached to the base 16 and moveable between an extended, supportive position and a folded position. With continuing reference to FIGS. 7 and 8, the legs 112–116 are illustrated in their extended and supportive positions. The legs 112–116 are adjustable in length so that the paint/sketch box 12 can be adjusted to the height of the artist, or accommodate an artist sitting on a stool or chair.

Each leg 112–116 is comprised of multiple extensions 118–122 which are slidably connected to one another. The first extension 118 is pivotally attached to the base 16. It includes an elongated opened-face channel 124 extending substantially the length thereof on one face of the leg 118. On an opposite face of the leg 118 is formed a slot 126 which extends to the opened faced channel 124. The second extension 120 has an end 128 which is configured to be received within the channel 124 of the first extension 118. This enables the second extension 120 to be slidably positioned along the length of the first extension of 118. The second extension 120 also includes an opened-faced channel 130 formed on one side thereof, and a slot 132 formed on an opposite side in communication with one another. A bolt (not shown) extends from the end 128 of the second extension 120 through the open-faced channel 124 and slot 126 to a hand-actuatable knob 134 which is threadably received upon bolt and which can be loosened to extend the second extension 120 relative to the first extension 118, or tightened to serve as a clamp and to temporarily fix the relative extension of the leg 112–116.

In the preferred embodiment illustrated, the third extension 122 comprises a foot bar slidably disposed within the open-faced channel 130 of the second extension 120. The foot bar 122 includes an exteriorly threaded bolt (not shown) which extends through the opened-faced channel 130 and slot 132 to a hand-actuatable knob 136 for adjusting the length of foot bar 122 relative to the second extension 120. Thus, the artist is capable of adjusting the height of the paint/sketch box 12 to a variety of heights, and also enabling the paint/sketch box to be positioned upon an uneven surface in a stable manner by adjusting the legs 112–116 to a different height, and clamping the extensions 118–122 in place.

Referring now to 10–13, each leg 112–116 is pivotally attached to the base 16 by means of a mount 138 affixed to a bottom surface of the bottom base wall 42. As illustrated, the mount 138 for the second and third legs 114 and 116 are positioned at approximately the front corner of the base 16. The mount 138 for the first leg 112 is attached to a back end of the base 116, in approximately the middle thereof, such that the legs 112–116 generally form a tripod structure when unfolded and extended.

Figure 10:
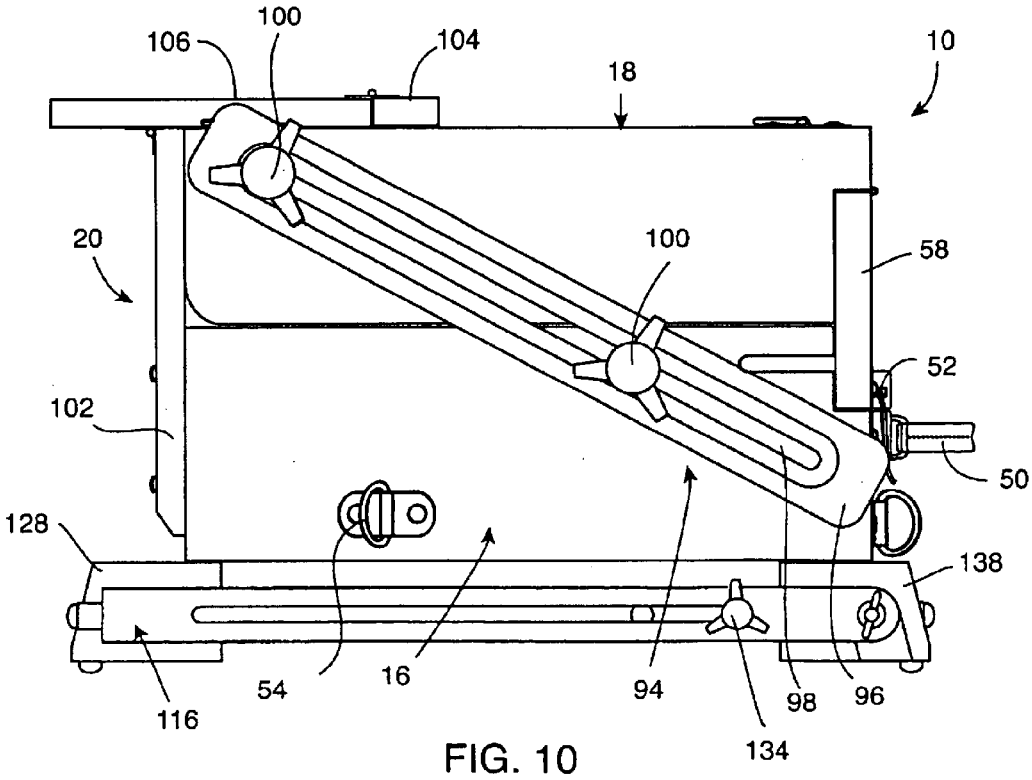
FIG. 10 is a side elevational view of the portable easel assembly in a closed and compact state.

Each mount 138 includes an opened-faced channel 140 which is configured to receive the end of the leg 112–116. The channel 140 includes a first opened end 142 directed generally transverse, or at a non-parallel angle to the plane of the base 16. That is, the opened end 142 is directed downwardly with respect to the base 16 such that the leg may extend therefrom in a supportive position. The channel 140 also includes a second opened end 144 which is directed generally coplanar or parallel to the plane of the base 16 so that the leg can be pivoted into the folded position adjacent to the base 16, as illustrated in FIGS. 9 and 10.

Figure 11:
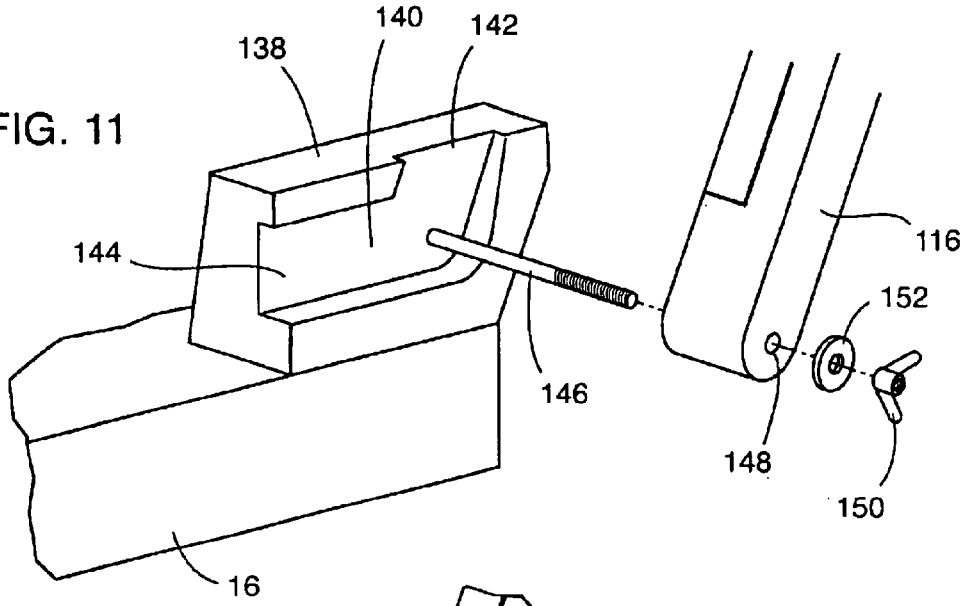
FIG. 11 is a partially exploded and fragmented perspective view of an end of a leg attachable to a mount of the portable easel assembly.
Figure 12:
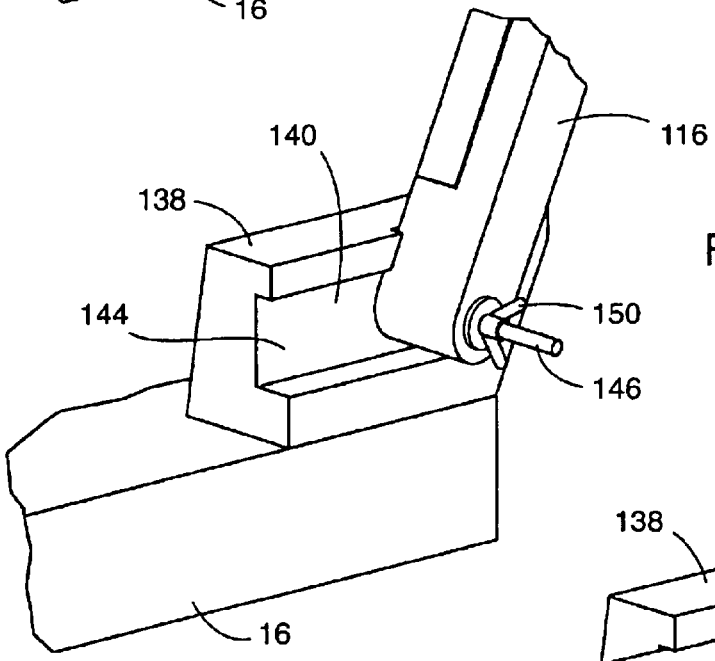
FIG. 12 is a partially fragmented perspective view of the leg attached to the mount and in an extended supportive position.
Figure 13:
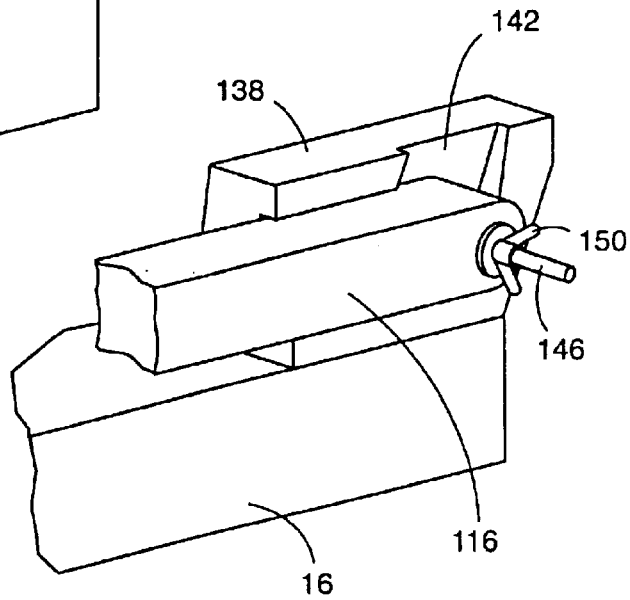
FIG. 13 is a fragmented perspective view the leg attached to the mount and pivoted into a folded and compact state.

With particular reference to FIGS. 11–13, a bolt 146 extends through the mount 138 and is permanently set there so it is not removable. An end of the leg 112–116 includes an aperture 148 therethrough so as to be inserted over the bolt 146. The end of the bolt 146 is exteriorly threaded so as to receive a wing nut 150 or the like. The wing nut 150 and washer 152 are loosened in order to allow the leg 112–116 to be lifted from the opened face channel 140 sufficiently so as to be pivoted into either the first or second opened end 142 or 144. With reference to FIG. 12, the leg 116 is illustrated extending through the second opened 142 in an unfolded and supportive position. The wing nut 150 is threaded onto bolt 146 until the leg 116 is clamped in position. The wing nut 150 can be loosened and the leg 116 pivoted into the second opened end 144 as illustrated in FIG. 13, so that the leg 116 lies parallel with and generally adjacent to the base 16 so that the assembly 10 is compact in nature and easily transported, as illustrated in FIGS. 9 and 10.

Although several embodiments have been described in detail for purposes of illustration, various modifications may be made without departing from the scope and spirit of the invention. Accordingly, the invention is not to be limited, except as by the appended claims.

What is claimed is:

1. A portable easel assembly, comprising:

a paint/sketch box having a base defining a cavity for storing art supplies, and a lid connected to the base by a hinge assembly and a slide bar assembly and having a front side configured to support a surface to be painted thereon;

wherein the slide bar assembly includes a slide bar having a slot substantially extending the length thereof and posts extending from the base and lid and into the slide bar slot and selectively positioned within the slot with hand-actuatable knobs which are selectively releasably placed in contact with the slide bar to lock the slide bar at a desired position;

wherein the hinge assembly comprises a first brace attached to an upstanding rear side surface of the base and extending upwardly to a point above a top edge of the base, a second brace attached to a top surface of the lid, and a third brace pivotally interconnected between the first and second braces; and wherein, due to the connection of the lid to the base by the slide bar assembly and hinge assembly, the lid is positionable from a closed position wherein the front side of the lid faces downwardly towards the box to an open position wherein the front side of the lid faces generally upwardly away from the box.

2. The assembly of claim 1, wherein the lid includes a front wall movable between open and closed positions, and opposing grooves formed on inner surfaces of the side walls thereof for reception of a canvas board.

3. A The assembly of claim 1, including wings pivotally attached to the base and having a plurality of apertures therethrough for the insertion of paint brushes.

4. The assembly of claim 1, including a paint mixing pallet slidably received within opposing grooves of side walls of the base.

5. The assembly of claim 1, including first, second and third legs of adjustable length pivotally attached to the base and movable between extended and folded positions.

6. The assembly of claim 5, wherein the first, second and third legs are each pivotally attached to a mount fixed to the base, each mount having an open-faced channel configured to receive an end of the leg, the channel including a first open end directed generally transverse to a plane of the base, and a second open end directed generally parallel to the plane of the base, wherein the legs are movable from a folded and supportive position extending through the second end of the channel to an unfolded and supportive position extending through the first end of the channel.

7. The assembly of claim 5, wherein each leg comprises first and second extensions slidably connected to one another, the second extension having at least a portion thereof slidably received in an open-faced channel of the first extension and secured in position with a clamp extending from the second extension through a slot of the first extension.

8. The assembly of claim 7, including a foot bar slidably disposed within an open-faced channel of the second extension with a clamp extending from the foot bar and through a slot of the second extension.

9. The assembly of claim 8, wherein each clamp comprises a threaded post extending through the slot to a hand-actuatable knob threadably received thereon.

10. A portable easel assembly, comprising:

a paint/sketch box having a base defining a cavity for storing art supplies, and a lid connected to the base by a hinge assembly and configured to support a surface to be painted thereon; and a slide bar assembly including a slide bar having a slot substantially extending the length thereof and posts extending from the base and lid and into the slide bar slot and selectively positioned within the slot with hand-actuatable knobs configured to be threaded onto the posts and into contact with the slide bar;

wherein the hinge assembly comprises a first brace attached to an upstanding rear side surface of the base and extending upwardly to a point above a top edge of the base, a second brace attached to a top surface of the lid, and a third brace pivotally interconnected between the first and second braces; and wherein, due to the connection of the lid to the base by the slide bar assembly and hinge assembly, the lid is positionable from a closed position wherein the front side of the lid faces downwardly towards the box to an open position wherein the front side of the lid faces generally upwardly away from the box.

11. The assembly of claim 10, wherein the lid includes a front wall movable between open and closed positions, and opposing grooves formed on inner surfaces of the side walls thereof for reception of a canvas board.

12. The assembly of claim 10, including wings pivotally attached to the base and having a plurality of apertures therethrough for the insertion of paint brushes.

13. The assembly of claim 10, including a paint mixing pallet slidably received within opposing grooves of side walls of the base.

14. The assembly of claim 10, including first, second and third legs of adjustable length pivotally attached to the base and movable between extended and folded positions.

15. The assembly of claim 14, wherein the first, second and third legs are each pivotally attached to a mount fixed to the base, each mount having an open-faced channel configured to receive an end of the leg, the channel including a first open end directed generally transverse to a plane of the base, and a second open end directed generally parallel to the plane of the base, wherein the legs are movable from a folded position extending through the second end of the channel to an unfolded and supportive position extending through the first end of the channel.

16. The assembly of claim 14, wherein each leg comprises first and second extensions slidably connected to one another, the second extension having at least a portion thereof slidably received in an open-faced channel of the first extension and secured in position with a clamp extending from the second extension through a slot of the first extension, and a foot bar slidably disposed within an open-faced channel of the second extension with a clamp extending from the foot bar and through a slot of the second extension.

17. The assembly of claim 16, wherein the clamps comprise a threaded post extending through the slot to a hand-actuatable knob threadably received thereon.

18. A portable easel assembly, comprising:

a paint/sketch box having a base defining a cavity for storing art supplies, and a lid connected to the base by a hinge assembly and configured to support a surface to be painted thereon;

a slide bar assembly including a slide bar having a slot substantially extending the length thereof and posts extending from the base and lid and into the slide bar slot and selectively positioned within the slot with hand-actuatable knobs; and first, second and third legs of adjustable length pivotally attached to the base and movable between extended and folded positions, wherein the first, second and third legs are each pivotally attached to a mount fixed to the base, each mount having an open-faced channel configured to receive an end of the leg, the channel including a first open end directed generally transverse to a plane of the base, and a second open end directed generally parallel to the plane of the base, wherein the legs are movable from a folded position extending through the second end of the channel to an unfolded and supportive position extending through the first end of the channel.

19. The assembly of claim 18, wherein the hinge assembly comprises a first brace attached to a rear surface of the base and extending upwardly to a point above a top edge of the base, a second brace attached to a top surface of the lid, and a third brace pivotally interconnected between the first and second braces.

20. The assembly of claim 18, wherein the lid includes a front wall movable between open and closed positions, and opposing grooves formed on inner surfaces of the side walls thereof for reception of a canvas board.

21. The assembly of claim 18, including wings pivotally attached to the base and having a plurality of apertures therethrough for the insertion of paint brushes.

22. The assembly of claim 18, including a paint mixing pallet slidably received within opposing grooves of side walls of the base.

23. The assembly of claim 18, wherein each leg comprises first and second extensions slidably connected to one another, the second extension having at least a portion thereof slidably received in an open-faced channel of the first extension and secured in position with a clamp extending from the second extension through a slot of the first extension, and a foot bar slidably disposed within an open-faced channel of the second extension with a clamp extending from the foot bar and through a slot of the second extension.

24. The assembly of claim 18, wherein the clamps comprise a threaded post extending through the slot to a hand-actuatable knob threadably received thereon.

* * * * *